US008133125B2

(12) United States Patent
Park

(10) Patent No.: US 8,133,125 B2
(45) Date of Patent: Mar. 13, 2012

(54) LEVERAGE DISCS

(76) Inventor: Othili Park, W. Warwick, RI (US)

( * ) Notice: Subject to any disclaimer, the term of this patent is extended or adjusted under 35 U.S.C. 154(b) by 0 days.

(21) Appl. No.: 12/951,056

(22) Filed: Nov. 21, 2010

(65) Prior Publication Data

US 2011/0183770 A1 Jul. 28, 2011

Related U.S. Application Data

(60) Provisional application No. 61/336,680, filed on Jan. 25, 2010.

(51) Int. Cl.
*A63B 69/36* (2006.01)
*A63B 22/00* (2006.01)

(52) U.S. Cl. ..... 473/218; 473/409; 482/146

(58) Field of Classification Search ..... 473/218, 473/266, 269, 270, 271, 278, 279, 422
See application file for complete search history.

(56) References Cited

U.S. PATENT DOCUMENTS

| | | | | | |
|---|---|---|---|---|---|
| 1,545,437 | A | * | 7/1925 | Malone et al. | 36/7.8 |
| 2,430,466 | A | * | 11/1947 | Hedman | 36/7.5 |
| 2,756,517 | A | * | 7/1956 | Youtz | 36/7.8 |
| 4,204,675 | A | * | 5/1980 | McGinnis | 482/80 |
| 4,774,776 | A | * | 10/1988 | Gulli | 36/132 |
| 5,003,653 | A | * | 4/1991 | Mar | 5/654 |
| 5,197,739 | A | | 3/1993 | Johnson, III | |
| 5,263,863 | A | | 11/1993 | Stefani | |
| 5,301,441 | A | * | 4/1994 | Kownacki | 36/7.8 |
| 5,308,075 | A | * | 5/1994 | Theriault | 473/279 |
| 5,318,290 | A | | 6/1994 | Sawyer | |
| 5,547,195 | A | | 8/1996 | Callanan | |
| 5,810,673 | A | | 9/1998 | Castleberry | |
| 5,916,036 | A | | 6/1999 | Hamilton | |
| 5,976,027 | A | | 11/1999 | Kachmar | |
| 6,039,658 | A | * | 3/2000 | Cecchin | 473/269 |
| D429,106 | S | * | 8/2000 | Bortolotto et al. | D6/604 |
| 6,551,225 | B1 | * | 4/2003 | Romero | 482/146 |
| 6,723,004 | B1 | | 4/2004 | Florian | |
| 7,018,301 | B1 | | 3/2006 | Cascerceri et al. | |
| 7,335,117 | B2 | | 2/2008 | Reason-Kerkhoff | |
| 7,513,840 | B2 | * | 4/2009 | Latella, Jr. | 473/409 |
| 2008/0064579 | A1 | * | 3/2008 | Weck et al. | 482/146 |

OTHER PUBLICATIONS http:// www.exertools.com/aboutus.html.
http:// ww.flexor.com/about-flexor.

* cited by examiner

*Primary Examiner* — Nini Legesse
(74) *Attorney, Agent, or Firm* — Antonelli, Terry, Stout & Kraus, LLP.

(57) ABSTRACT

A golf or tennis training apparatus for helping a player to improve his/her balance while practicing a swing using a disc shaped member of flexible material with an opening located in the top surface of the disc shaped member and a fluid located in the disc shaped member. The disc shaped member is an unstable support for a golf or tennis player to stand on to help improve the player's balance when swinging a golf club or a tennis racket.

20 Claims, 2 Drawing Sheets

LEVERAGE DISCS

REFERENCE TO RELATED APPLICATIONS

This patent application claims the benefit of U.S. Provisional Application No. 61/336,680 filed on Jan. 25, 2010, the disclosure of which is incorporated herein by reference in its entirety.

BACKGROUND OF THE INVENTION

1. Field of the Invention

The present invention relates to a training and practice aid for golfers and tennis players and more particularly to apparatus and method for helping a golf or tennis player improve his/her balance while practicing a swing.

2. Description of Related Art

A variety of golf teaching aids is available to golfers and tennis players to help them with their swing. More specifically, by way of example, U.S. Pat. No. 7,335,117 to Reason-Kerkhoff discloses a step plate and a swivel plate mounted on a flat base. The plates have adjustable separation, with the step plate fixable in a plurality of locations relative to the swivel plate. The plates align the hitter's feet using toe stops. The step plate has a foot guard that forces the hitter to step toward the pitch. The swivel plate rotates about a vertical axis, and has foot-retaining straps that allow the heel to lift. The hitter learns to step toward the ball and swivel the back foot while swinging, turning the body, and shifting weight toward the ball.

U.S. Pat. No. 7,018,301 to Cascerceri, et al. discloses a rocking footplate which alerts an athlete such as a golfer to the occurrence of improper rear foot weight placement. The footplate is placed under the athlete's rear foot and includes upper and lower plates which are joined by a hinge having an axis of rotation which is aligned with the center of the foot. The bottom of the device includes spikes which engage the ground to provide a stable base for the hinged top plate. The top plate is in the anatomical shape of a foot to aid proper foot placement on the device.

U.S. Pat. No. 6,723,004 to Florian discloses a golf training apparatus comprising a base pad with indicia for locating a golfer's feet for different golf swings, and a pair of footpads, one of which rocks on a fulcrum and the other is disposed in a non-rocking position for teaching a golfer a proper weight shift during his swing.

U.S. Pat. No. 5,976,027 to Kachmar discloses a device for stabilizing a golfer's feet and stance while he practices his swing. The device has a substantially flat mat in which a left foot gripping element and a right foot gripping element are each slidably engaged. The gripping element can secure a golfer's feet parallel to each other in a given stance while the golfer practices a golf swing. The gripping element can be slid nearer or farther away from each other and locked in the selected position to provide a variety of widths of stance.

U.S. Pat. No. 5,916,036 to Hamilton discloses a flat horizontal platform mounted on a base by a central board between the two. A golfer stands on the platform addressing a ball in front of the platform. The platform tilts left or right about the left or right side of the center board if the golfer's center of weight shifts beyond the left or right side of the enter board. A clicker between the base and platform on the back-swing side, alerts the golfer to an improper weight shift toward the back-swing, providing feedback during training to eliminate this stroke motion error.

U.S. Pat. No. 5,810,673 to Castleberry discloses a golf-swing training apparatus having a base, a rotator disc for receiving one foot of a user, and means for anchoring the apparatus to a playing surface. The rotator disc is pivotably coupled to the base by a screw. Friction reducing means is coupled between the rotator disc and the base to reduce rotational friction. Using the apparatus when making a golf swing, the user's foot will rotate on the rotator disc allowing the user to rotate her torso easily with minimal swaying. In addition, the user will be able to lift her heel while keeping the ball of her foot on the rotator disc.

U.S. Pat. No. 5,547,195 to Callanan discloses opposing right-hand and left-hand gripping portions or areas of a frame or circular disc. The gripping portions are spaced apart a distance somewhat equal to the golfer's waist width so that the arms are correctly positionable as in a proper golf stance and swing. By firmly grasping each gripping portion with the device positioned in front of the golfer similar to that of a golf club, the device may be swung and properly rotated during an entire practice golf swing to accurately simulate the hand, arm and body movement of a proper golf swing. Viewable arrow indicia positioned centrally on an obverse surface of the device viewably advises the golfer of the proper rotational orientation at each stage of the swing.

U.S. Pat. No. 5,318,290 to Sawyer discloses a swing training apparatus for temporarily immobilizing a users back foot except for pivotal movement; where the apparatus has a base member rotatably secured to a platform member; and, releasable securing means secures the user foot to the platform member for teaching the user the proper swing technique for baseball, softball and golf.

U.S. Pat. No. 5,263,863 to Stefani, et al discloses a base with a first foot pad and a second foot pad supported thereon, one of the foot pads being movable toward or away from the other foot pad. Each foot pad has a support surface upon which one foot of the golfer is placed. The support surface of the first foot pad is rotatable only from a horizontal position to an inwardly-facing position in relation to the second foot pad and the support surface of the second foot pad forms a predetermined angle with the base.

U.S. Pat. No. 5,197,739 to Johnson, III discloses a stepped surface upon which the golfer places his rear foot and a wand which extends in proximity to the rear hip. The upper surface of the base member, at the location of the rear foot of the golfer, includes a single step with the lower level beneath the inside edge of the foot and the upper level beneath the outside edge of the foot, the step itself being located approximately along the longitudinal center-line of the foot's position. Extending upwardly from the surface of the base member, a wand, positioned to be proximate the rear hip of the golfer during the normal pre-swing stance, indicates substantial body sway during the backswing by contact with the hip. The base member may include an artificial grass-like upper surface.

SUMMARY OF THE INVENTION

In an exemplary embodiment of the present invention, there is disclosed a golf or tennis training apparatus for helping a player improve his/her balance while practicing a swing comprising:

- a disc or square shaped member of flexible material;
- a centrally located opening that extends through the disc shaped member; and
- a fluid located in the disc shaped member;
- wherein the disc shaped member is an unstable support for a golf or tennis player to stand on to help improve the player's balance when swinging a golf club or a tennis racket.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

When playing golf or tennis it is important that the player first perfect his/her golf or tennis swing. One aspect that is required to obtain a proper swing in golf or tennis is the coordinated movement of the various parts of the players body to transfer energy from the feet to the hips, and then through the shoulders to the arms where the energy is released through the golf club head or the tennis racket.

To obtain a proper swing a player must first learn to coordinate the rotation of the various parts of his/her body while swinging a golf club or tennis racket. An important aspect of a proper swing is the follow through after the golf or tennis ball is hit. For example, in golf after the ball is hit the player must rotate his/her body about one leg to continue swinging the golf club all the way up and behind the player's back. In an overhand tennis swing the follow thru requires the player to bend forward after the ball is hit.

All of these various movements of a person's body must be performed with a smooth and graceful rhythm which can only be obtained if the player maintains his/her balance from start to finish.

Without proper balance, not only can a player's timing be affected but the player may not be able to consistently hit a golf or tennis ball with the same smooth coordinated rhythm and movement which is required to play a game with consistently good results.

One aspect of a golfer or tennis player's swing is the extent that the golfer or tennis player is able to continuously hit a golf or tennis ball with the same smooth coordinated movement of his/her body and arm swing while maintaining his/her balance.

While balance is only one aspect of the proper swing, it is an important aspect that golfers and tennis players often have difficulty in achieving.

This invention is directed to discs which provide a golfer or a tennis player with an unstable support base to stand on while practicing his/her swing. The unstable support helps to train and develop a proper swing sequence which can lead to a more balanced controlled swing having a smooth coordinated movement from start to hitting the ball and through to follow up.

Figure 1:
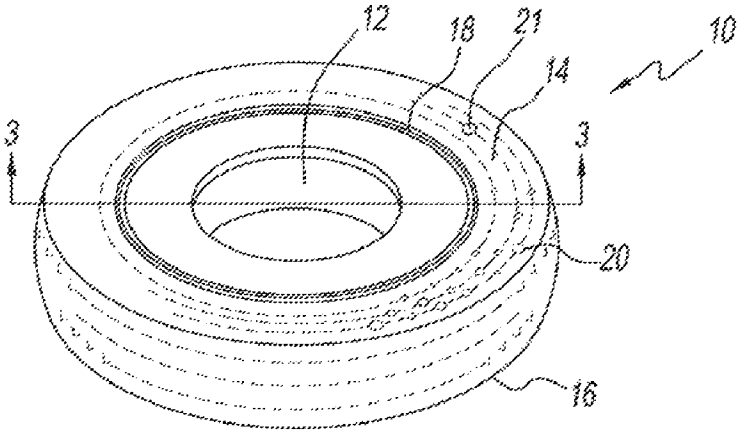
FIG. 1 is a top perspective view of a disc shaped member for a golf, tennis, racket ball etc. player to stand on to help improve a player's sense of balance while swinging a golf club, tennis racket, etc. for developing the proper body, arm coordination swing sequence.

Referring to FIG. 1, there is shown a top perspective view of a disc shaped member for a golf, tennis, racket ball etc. player to stand on to help improve a player's sense of balance while swinging a golf club, tennis racket, etc. to develop proper body, arm coordination swing sequence.

The disc shaped member 10, or in another embodiment a square or rectangular shaped member (not shown) has a centrally located opening 12 which extends completely thru the disc from the top surface 14 to the bottom surface 16. The disc shaped member 10 can be made of rubber, soft flexible plastic or PVC. The top surface 14 of the disc shaped member includes a protruding ring 18 which can have a width of between one-half of an inch more or less and a height of between one-quarter of an inch and two inches more or less. The upward projecting ring 18 can be composed of solid rubber or a plastic such as PVC and is provided to prevent the left foot of a right handed golf player or the right foot of a left handed player from sliding off the top of the disc during the follow thru part of the golf swing and to provide extra leverage or support.

In another embodiment, in place of the upward projecting ring there are a plurality of rings (not shown) where each ring consists of spaced apart half spherical or conical shaped projection having a height of one-thirty seconds of an inch, more or less.

Located around the circumference of the top surface 14 are three concentric rings 20 of spaced apart half spherical protrusions of soft rubber, hard rubber or plastic such as PVC. The protrusions 20 project up about one thirty second of an inch from the top surface to provide three concentric circles of protruding half spheres around the circumference of the top surface to provide extra leverage or support. The half spheres 20 also help prevent the left foot of a right handed golf player or the right foot of a left handed player from sliding off the top of the disc during the follow thru part of the golf swing. Disc 10 can be hollow and is filled with air at a fixed pressure which is at atmospheric pressure or at a pressure of between atmospheric pressure and twenty pounds per square inch (PSI) of pressure above atmospheric pressure.

In another embodiment of the invention the disc shaped member 10 can have an air valve (not shown) such as a needle valve similar to a needle valve on a foot ball for receiving air from a hand or electrically operated air pump. In this embodiment the air pressure in the disc shaped member can be controlled by the user and can be varied from atmospheric pressure up to a pressure which is desired by the user as long as the disc shaped member is unstable when a user stands on the disc 10.

It is understood that the disc is not limited to being filled with air but may be filled with any non-flammable compressible fluid such as air or a non-compressible fluid such as water where the fluid in the disc shaped member provides a non-stable platform when a user stands on the disc.

Figure 2:
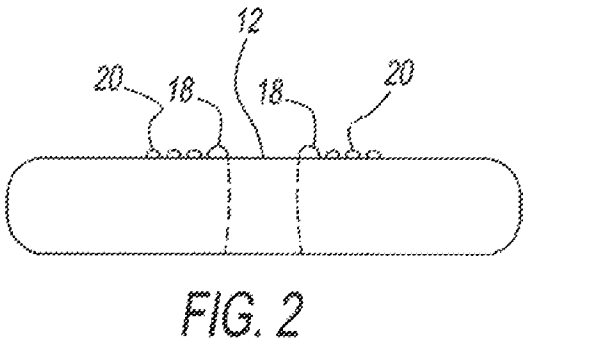
FIG. 2 is a side view of the disc shaped member of FIG. 1.

Referring to FIG. 2, there is shown a side view of the disc shaped member 10 of FIG. 1. The disc can have a diameter of fourteen inches more or less and a thickness of between two and one-half inches and four inches, more or less.

Figure 3:
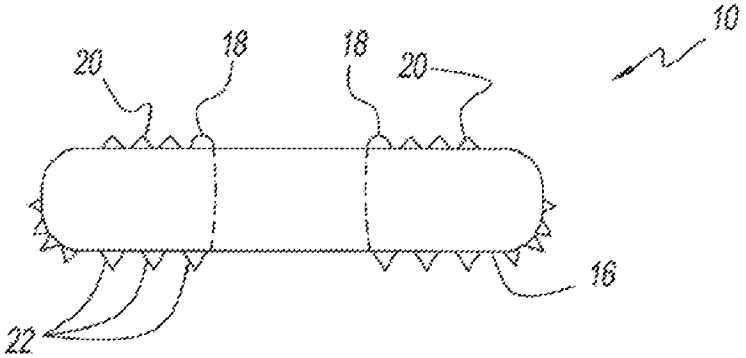
FIG. 3 is a sectional view along the line 3-3 of the disc shaped member of FIG. 1.

Referring to FIG. 3, there is shown a sectional view along the line 3-3 of the disc shaped member of FIG. 1. If desired, small conical shaped projections 22 may be located on the bottom surface 16 of the disc 10 to prevent the disc from moving during use. The projections can be of the same material as the bottom surface of the disc 10, such as rubber or plastic and can have a height of one quarter of an inch, more or less.

Figure 4:
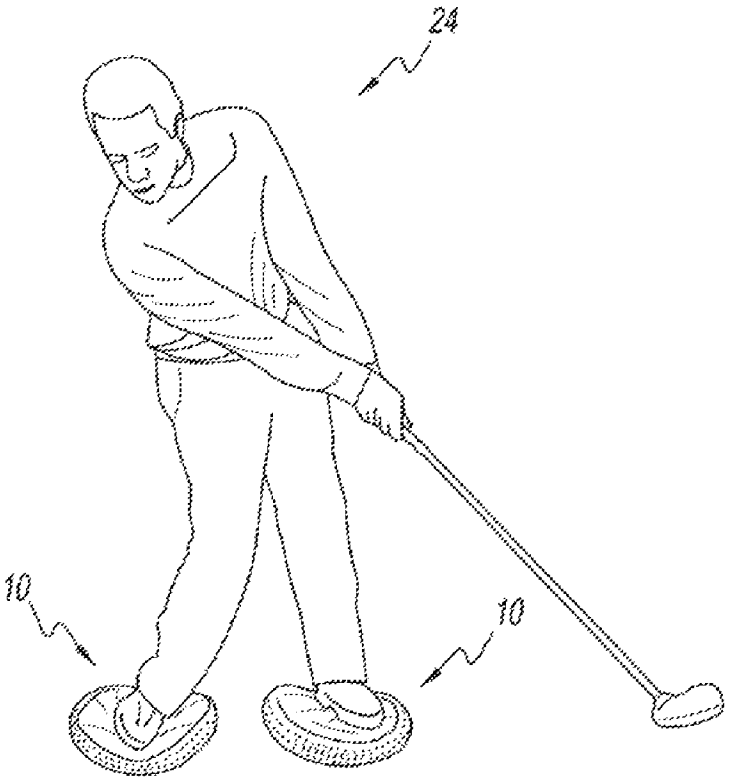
FIG. 4 is a view of a golfer practicing his swing while standing on two unstable disc shaped members in accordance with the principles of the invention.

Referring to FIG. 4, there is shown a view of a golfer 24 standing on two unstable disc shaped members to improve his balance while practicing hitting a golf ball with a smooth coordinated movement of his body and arms. The user places two disc shaped members 10 on a substantially flat surface such as the ground where he will be practicing his golf swing. After the user positions the two disc shaped members on the ground where he would normally stand, he retrieves a golf club and steps onto the two unstable disc shaped members. With his feet on the two unstable disc shaped members, the user can now start to practice his golf swing while, at the same time, practicing to keep his balance on the two unstable disc shaped members. Once the user has mastered keeping his balance on the unstable disc shaped members, he may want to practice his golf swing without the two unstable disc shaped members.

Figure 6:
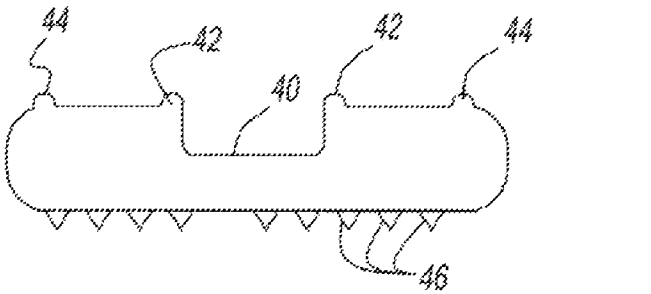
FIG. 6 is a sectional along the line 6-6 of FIG. 5.
Figure 5:
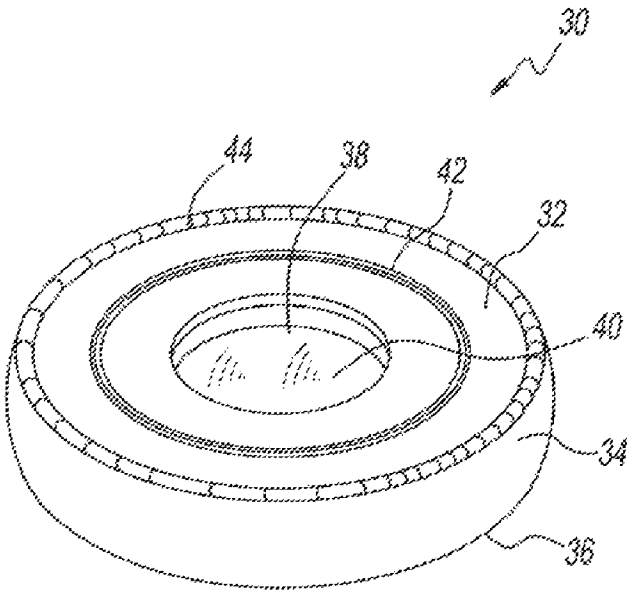
FIG. 5 is a top perspective view of another embodiment of the invention.

Referring to FIGS. 5 and 6, there is shown a top perspective view and a sectional view along the line 6-6 of FIG. 5 of another embodiment in accordance with the principles of the invention. In FIG. 5, the disc shaped member 30 has a top surface 32, a side wall 34 and a bottom surface 36. Located in the top surface 32 is a centrally located opening 38 which extends partially, not completely thru the disc shaped member. The bottom 40 of the centrally located opening 38, see FIG. 6, is spaced from the bottom surface 36 of the disc which extends completely across the bottom of the disc. Thus, the bottom of the centrally located opening is separated from the bottom surface of the disc shaped member by the compressible or non-compressible fluid in the disc shaped member.

The disc shaped member 30 can be made of rubber, a soft flexible plastic or PVC. The top surface 32 of the disc shaped member includes a protruding ring 42 which can have a width of between one-half of an inch more or less and a height of between one-quarter of an inch and two inches more or less. The upward projecting ring 42 can be composed of solid rubber or plastic such as PVC and is provided to prevent the left foot of a right handed golf player or the right foot of a left handed player from sliding off the top of the disc during the follow thru part of the golf swing.

Located around the circumference of the top surface 32 is a ring 44 of hard rubber or plastic such as PVC. Ring 44 may be a continuation of the top surface 32 or it may project up from the top surface to provide a protruding rim around the circumference of the top surface. The ring 44 is provided to also prevent the left foot of a right handed golf player or the right foot of a left handed player from sliding off the top of the disc during the follow through part of the golf swing. Disc 10, which can be hollow, is filled with air at a fixed pressure which may be at atmospheric pressure or it may be filled with air at a pressure of between atmospheric pressure and twenty pounds per square inch (PSI) above atmospheric pressure.

The disc shaped member 30 can have an air valve (not shown) such as a needle valve for receiving air from a hand or electrically operated air pump. The air pressure in the disc shaped member 30 can be at a pressure that is determined by the manufacturer or can be varied from atmospheric pressure to any pressure which is desired by the user as long as the disc shaped member is unstable when a user stands on the disc 30.

It is understood that the disc 30 is not limited to being filled with air but may be filled with any non-flammable compressible fluid such as air or a non-compressible fluid such as water where the fluid in the disc shaped member provides a non-stable platform when a user stands on the disc.

Continuing with FIG. 5, the disc can have a diameter of fourteen inches more or less and a thickness of between two and one-half inches and four inches, more or less. If desired, small conical shaped projections 46 (see FIG. 6) may be located on the bottom surface 36 of the disc 30 to prevent the disc from moving during use. The projections can be of the same material as the bottom surface 36 of the disc 30, such as rubber or plastic and can have a height of one quarter of an inch, more or less.

It is understood that disc shaped members 10 and 30 are nor limited to being circular but can have a shape which is other than circular and can have a shape that is rectangular, square, oblong, etc.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A golf or tennis training apparatus for a golf or tennis player, comprising:

a disc or square shaped member of flexible material;

a centrally located opening in a top surface of the disc shaped member; and a fluid located in the disc shaped member;

wherein the centrally located opening is sized and shaped so that portions of the foot of the golf or tennis player remain on the top surface of the disc shaped member outside the centrally located opening so that the disc shaped member is an unstable support for the golf or tennis player to stand on to help improve the player's balance when swinging a golf club or a tennis racket.

2. The apparatus of claim 1, wherein the centrally located opening has a circular cross section.

3. The apparatus of claim 1, wherein the fluid in the disc shaped member is compressible.

4. The apparatus of claim 3, wherein the fluid in the disc shaped member is at a pressure of between atmospheric pressure and twenty pounds per square inch (PSI) of pressure above atmospheric pressure.

5. The apparatus of claim 4, wherein the fluid in the disc shaped member is air.

6. The apparatus of claim 5, wherein a ring of material which is raised above the top surface of the disc is located between centrally located opening and the circumference of the disc.

7. The apparatus of claim 6, wherein the ring of material is between one-quarter of an inch and two inches high.

8. The apparatus of claim 7, wherein the ring of material is a plastic or rubber.

9. The apparatus of claim 8, wherein the ring of material is PVC.

10. The apparatus of claim 7, wherein the centrally located opening extends fully thru the disc shaped member from the top to the bottom surface.

11. The apparatus of claim 10, wherein a ring of hard rubber or plastic.

12. The apparatus of claim 10, wherein the ring projects up from the top surface to provide a protruding rim around the circumference of the top surface to provide extra leverage or support.

13. The apparatus of claim 7, wherein the centrally located opening extends partially thru the disc shaped member from the top surface toward the bottom surface.

14. The apparatus of claim 1, wherein the fluid is non-compressible.

15. The apparatus of claim 14, wherein the fluid in the disc shaped member is water.

16. The apparatus of claim 1, wherein the disc shaped member is made of rubber, a plastic or PVC.

17. A method for helping a golf or tennis player to improve his/her balance while practicing a swing, comprising:

providing at least one disc shaped member of flexible material or a substantially flat surface, the disc shaped member having a centrally located opening in a top surface of the disc shaped member and a fluid in the disc shaped member;

having the golf or tennis player step on the at least one disc shaped member so that portions of the foot of the golf or tennis player remain on the top surface of the disc shaped member outside the centrally located opening, wherein the disc shaped member is an unstable support for a golf or tennis player to stand on to help improve the player's balance when swinging a golf club or a tennis racket; and having the golf or tennis player practice a golf or tennis swing while balancing on the at least one disc shaped member.

18. The method of claim 17, wherein a disc shaped member is provided for each of the player's feet.

19. The method of claim 17, wherein the fluid is compressible.

20. The method of claim 17, wherein the fluid in the disc shaped member is at a pressure of between atmospheric pressure and twenty pounds per square inch (PSI) of pressure above atmospheric pressure.

* * * * *